United States Patent [19]

Norris et al.

[11] 4,436,592

[45] Mar. 13, 1984

[54] METHOD OF SELECTIVELY ELECTROPLATING THE NODES OF DIMPLED TITANIUM MATERIAL

[75] Inventors: Brian Norris, San Diego; Robert M. Castro, La Mesa, both of Calif.

[73] Assignee: Rohr Industries, Inc., Chula Vista, Calif.

[21] Appl. No.: 488,351

[22] Filed: Apr. 25, 1983

[51] Int. Cl.[3] ..... C25D 5/02

[52] U.S. Cl. ..... 204/15; 204/224 R

[58] Field of Search ..... 204/15, 224 R

[56] References Cited

U.S. PATENT DOCUMENTS

| | | | |
|---|---|---|---|
| 1,739,657 | 12/1929 | Shemitz | 204/224 R |
| 2,540,602 | 2/1951 | Thomas | 204/224 R |
| 3,061,526 | 10/1962 | Skolnick | 204/15 |
| 3,745,105 | 7/1973 | Kosowsky | 204/224 R |
| 4,001,093 | 1/1977 | Koontz | 204/15 |

*Primary Examiner*—T. M. Tufariello

*Attorney, Agent, or Firm*—Patrick J. Schlesinger; Frank D. Gilliam

[57] ABSTRACT

A process for selectively electroplating the nodes of dimpled titanium material. A sheet of clean dimpled titanium material is placed on a electrolyte saturated absorbent fabric covered block of conductive material. A flat sheet of metal, such as, stainless steel is placed on the opposite surface of the dimpled sheet to provide dead weight to hold only the nodes of the dimpled sheet in contact the absorbent material the dimpled sheet serving as one electrode for the electroplating process. The conductive block being the other electrode. Current is then passed through the electrolyte solution between the electrodes causing only the nodes to become plated. The electrolyte may contain, for example, copper or nickel in solution. A plating mask in the form of a frame may be placed between the flat sheet of metal and the dimpled sheet to provide uniform plating of the node surfaces. The process is repeated for the opposite side of the dimpled sheet and for successive layers of the same or different plating solution.

12 Claims, 3 Drawing Figures

METHOD OF SELECTIVELY ELECTROPLATING THE NODES OF DIMPLED TITANIUM MATERIAL

BACKGROUND OF THE INVENTION

This invention relates to an improvement in electroplating and more particularly, but not by way of limitation to evenly electroplating only the nodes of dimpled titanium material.

Examples of prior art teachings directed to electroplating only in selected areas are found in U.S. Pat. Nos. 3,061,526; 3,745,105; 4,001,093; and 4,294,664.

U.S. Pat. No. 3,061,526 is directed to the plating of islands on stacked printed circuit boards and includes the placement of springs for conduction between the layers of circuit boards to complete the current flow between the plating electrodes. The circuit board stack is then submerged into the electrolyte for a conventional plating operation.

U.S. Pat. No. 3,745,105 teaches the use of a press employing upper and lower members. The members include selective patterns of seals which when brought together with the material to be plated therebetween prevent plating under the seal surfaces. The plating operation is then performed in a conventional manner by effectively emersing the material in the electrolyte solution and passing D.C. current therethrough.

U.S. Pat. No. 4,001,093 likewise teaches localized emersion of the material to be plated. The plating operation is then performed in a conventional manner.

U.S. Pat. No. 4,294,664 teaches the use of a plating mask wherein the unmasked portion of the material is that portion to be plated. The unmasked portion of the material is then effectively emersed in the electrolyte solution and plated in a conventional manner.

SUMMARY OF THE INVENTION

The present invention provides a new and novel process for electroplating only the external facing node surfaces of a dimpled sheet of titanium material. The plated portion of the sheets are later liquid interface diffusion (LID) bonded to adjacent flat or like sheets to form sandwich structures. Examples of such bonding can be found in U.S. Pat. Nos. 3,769,101 and 3,854,194 assigned to the same assignee as is this invention.

This invention provides a process for plating just the node surfaces and provides a uniform thickness to that plating.

An object of this invention is to reduce the number of process steps currently required to plate dimpled titanium sheets.

Another object is to reduce the economic cost in the production of plated dimpled titanium sheets.

Still another object is to provide a uniform thickness to the plating material deposited on dimpled titanium material.

These and other objects and advantages of the invention will become better understood by reference to the following detailed description, when considered with the drawings in which:

DETAILED DESCRIPTION OF THE DRAWINGS

Figure 1:
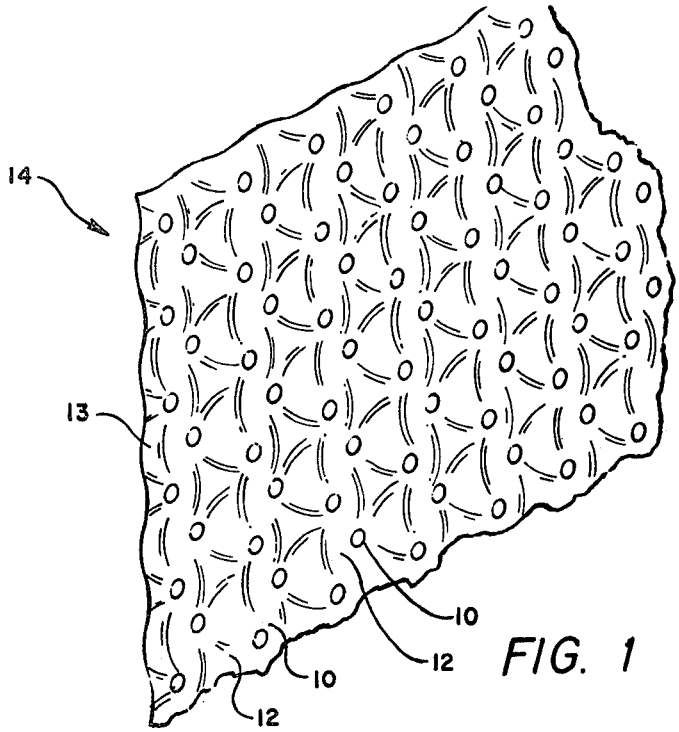
FIG. 1 is a perspective showing of a sheet of dimpled material to be plated.

The process hereinafter described in more detail relates to the surface plating of the flat bottom surface 10 of the nodes 12 of a thin sheet of dimpled material 14. For purposed of illustration the nodes 12 are shown to be flat but other configurations of such nodes would be within the scope of the present invention. The material 14, for the purpose of explanation, is generally formed from titanium material. Conceivably other types of metal dimpled sheets could be plated in the same or similar manner. The nodes 12 extend in both directions from the normal surface 13 of the material, thus providing two opposite parallel surfaces of node bottom surfaces 10.

Figure 2:
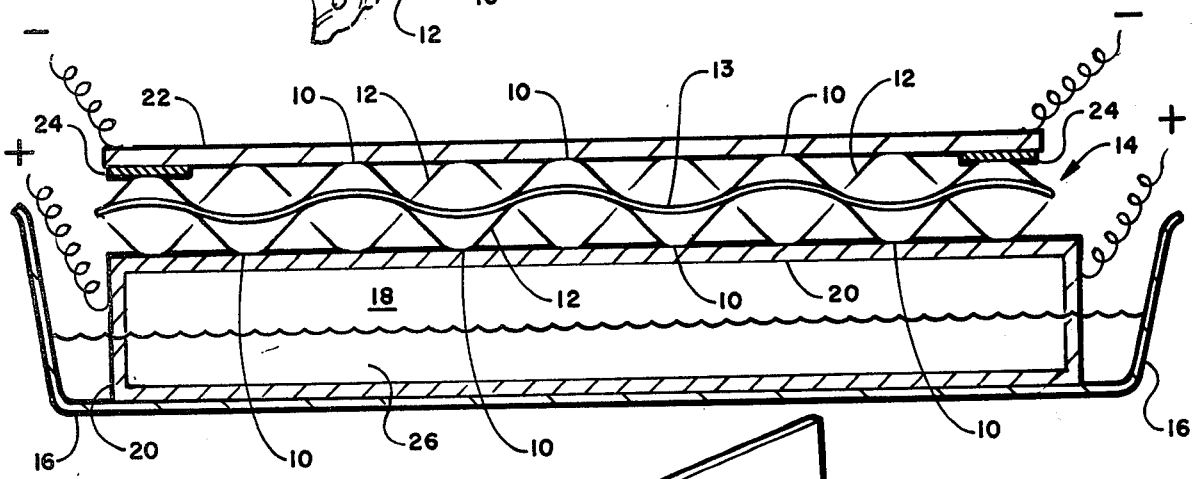
FIG. 2 is a cutaway end schematic showing of the electroplating of the dimple nodes of the material of FIG. 1.

Referring now specifically to FIG. 2, wherein the placement of the various elements utilized in the plating of the nodes surface 10 of the dimpled sheet 14 are shown.

A non-metallic container 16 is preferably used to hold the elements of the process. A block of electrical conductive material 18 having at least one flat surface, such as graphite by way of example and not by way of limitation, is positioned within the container 18. A layer of porous fluid absorbent fabric material 20 (such as for example gauze or the like), is either positioned on the upper surface of the flat block 18 or wrapped around the block as shown. The dimpled material 14 is then placed with the bottom surfaces 10 of the nodes 12 resting upon the layer of porous fabric material. A sheet 22 of conductive material, such as stainless steel, or the like is then placed on the other or upper surface of the dimpled sheet 14. This sheet 22 provides one of the electrodes, as does the flat block 18, and further provides a dead weight to hold the titanium sheet 14 in electrical contact with the porous fabric material and the block 18. A selected electrolyte 26 containing the desired metal to be electroplated fills the container 16 to a level suitable to saturate the porous fabric as will be described in detail hereinafter, material making it a series element of the plating system.

The flat block 18 becomes the insoluble anode and the dimple material 14 the cathode of the plating system. These electrodes are suitably connected to a source of D.C. voltage generally used for electroplating.

Figure 3:
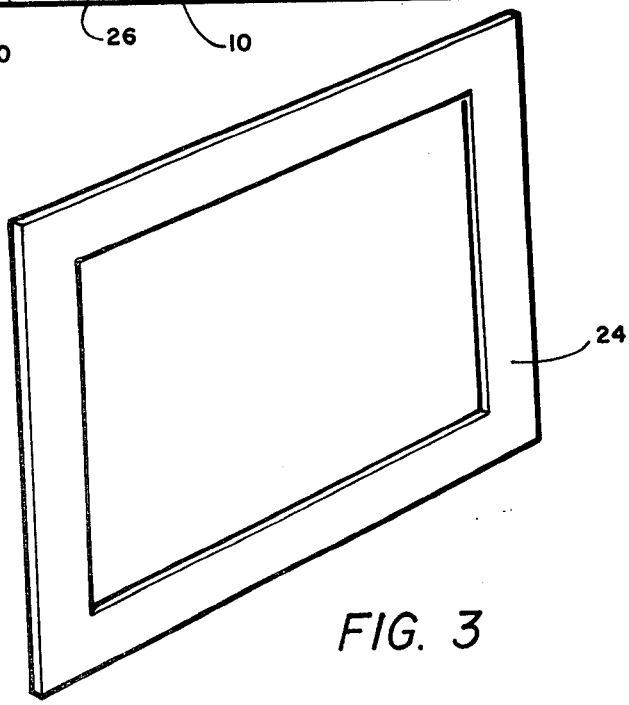
FIG. 3 is a mask used to enhance the plating process.

It has been found that when a mask 24, as shown in FIGS. 2 and 3, is used to frame the outer periphery of the sheet of dimpled material, substantially even thicknesses of plating material is deposited on all of the bottom surfaces 10. Without the mask the outer surfaces 10 receive a greater thickness of plating material due to their close proximity to the electrode connections and edging effects and as a result must be trimmed from the dimpled sheet after plating before they can be liquid interface diffusion bonded together.

Process Steps

The entire surface of the dimpled titanium sheet 12 is dust blasted. The porous fabric covered graphite block 18 is then placed in the container 16. The container 16 is filled with copper electrolyte solution, for example, when copper is to be electroplated, to a level wherein the electrolyte solution 26 saturates the porous fabric material, generally to a level at least halfway up the block 18. The graphite block is then removed from the electrolyte solution 26. The block is held vertically for about thirty seconds or until the fabric is void of excess liquid. The block is then placed back into the container 16 in an opposite manner. The previous bottom surface now becomes the top surface and vice versa. A wait of about thirty seconds or until dispersion of the liquid through the fabric 20 evens out is desirable. The electrolyte solution 26 then "wicks up" through the material 20 to maintain it in a saturated condition. Other ways of wetting the material 20 with the electrolyte solution 26 to the desired saturation point will be readily apparent.

The dimpled sheet 14 is then placed on the saturated fabric material 20 and the mask 24 is then placed on the dimple sheet 14. The sheet 22 is then placed on top of the mask 24 and the dimpled sheet 14 to hold it in place and to act as the upper electrode (cathode). The electroplate D.C. voltage is then applied to the electrodes for a predetermined period of time. The positive to the flat block 18 acting as the anode and the negative to the sheet 22 acting as the cathode. The procedure is repeated for the opposite side of the dimpled sheet.

When nickel is to be plated on the flat bottom surface 10 of the dimpled sheet 14, a nickel electrolyte is used in place of the copper electrolyte. For copper plating typically 20 amp/ft2 is applied to the exposed areas and for nickel plating typically 15 amps amp/ft2 is applied to the exposed areas for as long as may be required to achieve the desired thickness of plating.

As set forth in U.S. Pat. No. 3,957,194, sequential layers of copper, nickel and copper are used in the bonding described. The flat surfaces 10 of the dimpled material 14 can be plated in a desired manner by sequentially plating both sides alternately between copper and nickel electrolyte solutions.

This invention may be embodied in other forms or carried out in other ways without departing from the spirit or essential characteristics thereof. The present embodiments and examples of this invention are therefore to be considered as in all respects illustrative and not restrictive in scope of the invention being indicated by the appended claims, and all changes which come within the meaning and range of equivalency of the claims are intended to be embraced therein.

Having thus described the invention, what is claimed as new and useful and desired to be secured by United States Letters Patent, is:

1. A process for electroplating the nodes of dimpled sheet material comprising the steps of:

(a) providing a flat block of electrical conductive material having at least one substantially flat surface;

(b) positioning on the flat surface of said block; a porous absorbent fabric material;

(c) wetting the porous fabric material with a electrolyte solution;

(d) placing one node surface of a cleaned dimpled sheet of material on the wetted porous fabric material;

(e) placing a sheet of conductive material on the other surface of the dimpled sheet for holding said sheet against said wetted porous fabric material;

(f) attaching electrodes to said block of electrical conductive material and to said sheet of conductive metal; and (g) applying appropriate plating voltage to said electrodes for a predetermined period of time.

2. The process of claim 1, further including placing the block of conductive material in a non-conductive container partially filled with the electrolyte solution to maintain the fabric material in a saturated condition by capillary action.

3. The process of claim 1 and further including the step of interposing a apertured mask between the dimpled sheet material and the sheet of conductive material.

4. The process as defined in claim 1 further including repeating steps (d) through (g) on the opposite side of said dimpled sheet.

5. The process as defined in claim 1 wherein said block of electrical conductive material is graphite.

6. The process as defined in claim 1 wherein said porous fabric material is a gauze type cloth.

7. The process as defined in claim 1 wherein said electrolyte solution contains copper.

8. The process as defined in claim 1 wherein said electrolyte solution contains nickel.

9. The process as defined in claim 1 wherein the flat block of electrical conductive material is the anode electrode and the dimpled sheet is the cathode electrode.

10. The process as defined in claim 3 herein said masking material is non-conductive.

11. A node plated sheet of material produced according to the process of claim 1.

12. The node plated sheet of material produced according to the process of claim 3.

* * * * *